US006666233B1

(12) United States Patent
Sorkin

(10) Patent No.: US 6,666,233 B1
(45) **Date of Patent: *Dec. 23, 2003**

(54) TENDON RECEIVING DUCT

(76) Inventor: Felix L. Sorkin, 13022 Trinity Dr., Stafford, TX (US) 77477

( * ) Notice: Subject to any disclaimer, the term of this patent is extended or adjusted under 35 U.S.C. 154(b) by 0 days.

This patent is subject to a terminal disclaimer.

(21) Appl. No.: 10/378,151

(22) Filed: Mar. 4, 2003

Related U.S. Application Data

(63) Continuation-in-part of application No. 09/752,126, filed on Dec. 29, 2000.

(51) Int. Cl.[7] ..... F16L 9/06

(52) U.S. Cl. ..... 138/121; 138/173; 138/177; 138/110

(58) Field of Search ..... 138/121, 173, 138/177, 110

(56) References Cited

U.S. PATENT DOCUMENTS

| | | | | | |
|---|---|---|---|---|---|
| 3,578,777 | A | * | 5/1971 | DeGain | 183/121 |
| 3,605,817 | A | * | 9/1971 | Bauman et al. | 138/121 |
| 3,715,454 | A | * | 2/1973 | Kleykamp | 174/47 |
| 4,194,081 | A | * | 3/1980 | Medford et al. | 174/47 |
| 4,592,231 | A | * | 6/1986 | Kant | 73/295 |
| 5,439,035 | A | * | 8/1995 | Dal Paluú Attilio | 138/121 |
| 5,474,335 | A | | 12/1995 | Sorkin | 285/322 |
| 5,706,864 | A | * | 1/1998 | Pfleger | 138/121 |
| 5,720,139 | A | | 2/1998 | Sorkin | 52/223.13 |
| 5,762,300 | A | | 6/1998 | Sorkin | 248/78 |
| 5,775,849 | A | | 7/1998 | Sorkin | 405/259.1 |
| 5,792,532 | A | * | 8/1998 | Pfleger | 428/36.9 |
| D400,670 | S | | 11/1998 | Sorkin | D23/393 |
| 5,944,059 | A | * | 8/1999 | Masui | 138/121 |
| 5,954,373 | A | | 9/1999 | Sorkin | 285/312 |
| 6,550,816 | B1 | * | 4/2003 | Sorkin | 285/139.1 |
| 2002/0083991 | A1 | | 7/2002 | Sorkin | 138/121 |

* cited by examiner

*Primary Examiner*—Patrick Brinson
(74) *Attorney, Agent, or Firm*—Harrison & Egbert

(57) ABSTRACT

A tendon receiving duct having a tubular body with a plurality of corrugations extending radially outwardly therefrom. Each of the corrugations is in spaced relationship to an adjacent corrugation. The tubular body has an interior passageway suitable for receiving cables therein. Each of the corrugations opens to the interior passageway. The tubular body has a first longitudinal channel extending between adjacent pairs of the corrugations on a top side of the tubular body. The tubular body has a pair of longitudinal channels extending between adjacent pairs of the corrugations on a bottom side of said tubular body.

13 Claims, 4 Drawing Sheets

TENDON RECEIVING DUCT

RELATED U.S. APPLICATIONS

The present application is a continuation-in-part of U.S. patent application Ser. No. 09/752,126, filed on Dec. 29, 2000, and entitled "TENDON-RECEIVING DUCT WITH LONGITUDINAL CHANNELS", presently pending.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates to ducts as used in post-tension construction. More particularly, the present invention relates to the formation of a polymeric duct used for retaining multi-strand tensioning systems within an encapsulated environment.

BACKGROUND OF THE INVENTION

For many years, the design of concrete structures imitated the typical steel design of column, girder and beam. With technological advances in structural concrete, however, its own form began to evolve. Concrete has the advantages of lower cost than steel, of not requiring fireproofing, and of its plasticity, a quality that lends itself to free flowing or boldly massive architectural concepts. On the other hand, structural concrete, though quite capable of carrying almost any compressive load, is weak in carrying significant tensile loads. It becomes necessary, therefore, to add steel bars, called reinforcements, to concrete, thus allowing the concrete to carry the compressive forces and the steel to carry the tensile forces.

Structures of reinforced concrete may be constructed with load-bearing walls, but this method does not use the full potentialities of the concrete. The skeleton frame, in which the floors and roofs rest directly on exterior and interior reinforced-concrete columns, has proven to be most economic and popular. Reinforced-concrete framing is seemingly a quite simple form of construction. First, wood or steel forms are constructed in the sizes, positions, and shapes called for by engineering and design requirements. The steel reinforcing is then placed and held in position by wires at its intersections. Devices known as chairs and spacers are used to keep the reinforcing bars apart and raised off the form work. The size and number of the steel bars depends completely upon the imposed loads and the need to transfer these loads evenly throughout the building and down to the foundation. After the reinforcing is set in place, the concrete, a mixture of water, cement, sand, and stone or aggregate, of proportions calculated to produce the required strength, is placed, care being taken to prevent voids or honeycombs.

One of the simplest designs in concrete frames is the beam-and-slab. This system follows ordinary steel design that uses concrete beams that are cast integrally with the floor slabs. The beam-and-slab system is often used in apartment buildings and other structures where the beams are not visually objectionable and can be hidden. The reinforcement is simple and the forms for casting can be utilized over and over for the same shape. The system, therefore, produces an economically viable structure. With the development of flat-slab construction, exposed beams can be eliminated. In this system, reinforcing bars are projected at right angles and in two directions from every column supporting flat slabs spanning twelve or fifteen feet in both directions.

Reinforced concrete reaches its highest potentialities when it is used in pre-stressed or post-tensioned members. Spans as great as one hundred feet can be attained in members as deep as three feet for roof loads. The basic principle is simple. In pre-stressing, reinforcing rods of high tensile strength wires are stretched to a certain determined limit and then high-strength concrete is placed around them. When the concrete has set, it holds the steel in a tight grip, preventing slippage or sagging. Post-tensioning follows the same principle, but the reinforcing tendon, usually a steel cable, is held loosely in place while the concrete is placed around it. The reinforcing tendon is then stretched by hydraulic jacks and securely anchored into place. Pre-stressing is done with individual members in the shop and post-tensioning as part of the structure on the site.

In a typical tendon tensioning anchor assembly used in such post-tensioning operations, there are provided anchors for anchoring the ends of the cables suspended therebetween. In the course of tensioning the cable in a concrete structure, a hydraulic jack or the like is releasably attached to one of the exposed ends of each cable for applying a predetermined amount of tension to the tendon, which extends through the anchor. When the desired amount of tension is applied to the cable, wedges, threaded nuts, or the like, are used to capture the cable at the anchor plate and, as the jack is removed from the tendon, to prevent its relaxation and hold it in its stressed condition.

Multi-strand tensioning is used when forming especially long post-tensioned concrete structures, or those which must carry especially heavy loads, such as elongated concrete beams for buildings, bridges, highway overpasses, etc. Multiple axially aligned strands of cable are used in order to achieve the required compressive forces for offsetting the anticipated loads. Special multi-strand anchors are utilized, with ports for the desired number of tensioning cables. Individual cables are then strung between the anchors, tensioned and locked as described above for the conventional monofilament post-tensioning system.

As with monofilament installations, it is highly desirable to protect the tensioned steel cables from corrosive elements, such as de-icing chemicals, sea water, brackish water, and even rain water which could enter through cracks or pores in the concrete and eventually cause corrosion and loss of tension of the cables. In multi-strand applications, the cables typically are protected against exposure to corrosive elements by surrounding them with a metal duct or, more recently, with a flexible duct made of an impermeable material, such as plastic. The protective duct extends between the anchors and in surrounding relationship to the bundle of tensioning cables. Flexible duct, which typically is provided in 20 to 40 foot sections is sealed at each end to an anchor and between adjacent sections of duct to provide a water-tight channel. Grout then may be pumped into the interior of the duct in surrounding relationship to the cables to provide further protection.

Various patents have issued, in the past, for devices relating to such multi-strand duct assemblies. For example, U.S. Design Pat. No. 400,670, issued on Nov. 3, 1998, to the present inventor, shows a design of a duct. This duct design includes a tubular body with a plurality of corrugations extending outwardly therefrom. This tubular duct is presently manufactured and sold by General Technologies, Inc. of Stafford, Tex., the licensee of the present inventor. In particular, FIGS. 1 and 2 are illustrations of the prior art duct that is being manufactured by General Technologies, Inc.

As can be seen in FIG. 1, the tubular duct 10 has a tubular body 12 and a plurality of corrugations 14 which extend radially outwardly from the outer wall 16 of the tubular body 12. The tubular body 12 includes an interior passageway 14 suitable for receiving multiple post-tension cables and strands therein. The interior passageway 18 of the tubular body 12 is suitable for receiving a grout material so as to maintain the multiple strands in a liquid-tight environment therein. FIG. 2 shows the tubular body 12 as having the corrugations 14 extending outwardly in generally spaced parallel relationship to each other and in transverse relationship to the longitudinal axis of the tubular body 12. A wall 16 will extend between the corrugations 14. The tubular body 12, along with the corrugations 16, are formed of a polymeric material. The duct 12 can be any length, as desired. Couplers can be used so as to secure lengths of duct 10 together in end-to-end relationship.

One of the problems associated with the prior art duct 10 is that it is not stiff enough in the longitudinal direction. The duct 10 will flex too easily. It becomes difficult to profile such an easily flexible duct. When the cables are being installed in the interior passageway 18, the cablepusher that is used to install the cable within the interior passageway 18 is likely to strike the walls of the interior passageway 18 when the duct is flexed. Because of the force used to install the cable through the duct 10, the walls of the duct can break or become damaged if the cable strikes the walls of the duct. It is desirable to manufacture a duct 10 with greater stiffness and rigidity in the longitudinal direction so as to avoid the flexing and deflection of the duct.

An additional problem with the duct 10, as shown in FIGS. 1 and 2, is that air has a possibility of being trapped in the corrugations. When air bubbles form within the interior of the corrugations, the grout used to seal the interior 18 does not effectively encapsulate the cable on the interior 18. As such, it is desirable to manufacture the duct 10 such that the potential for trapped air bubbles within the corrugations 14 is reduced.

The present inventor is also the inventor of U.S. Pat. No. 5,474,335, issued on Dec. 12, 1995. This patent describes a duct coupler for joining and sealing between adjacent sections of duct. The coupler includes a body and a flexible cantilevered section on the end of the body. This flexible cantilevered section is adapted to pass over annular protrusions on the duct. Locking rings are used to lock the flexible cantilevered sections into position so as to lock the coupler onto the duct. U.S. Pat. No. 5,762,300, issued on Jun. 9, 1998, to the present inventor, describes a tendon-receiving duct support apparatus. This duct support apparatus is used for supporting a tendon-receiving duct. This support apparatus includes a cradle for receiving an exterior surface of a duct therein and a clamp connected to the cradle and extending therebelow for attachment to an underlying object. The cradle is a generally U-shaped member having a length greater than a width of the underlying object received by the clamp. The cradle and the clamp are integrally formed together of a polymeric material. The underlying object to which the clamp is connected is a chair or a rebar.

U.S. Pat. No. 5,954,373, issued on Sep. 21, 1999 to the present inventor, shows another duct coupler apparatus for use with ducts on a multi-strand post-tensioning system. The coupler includes a tubular body with an interior passageway between a first open end and a second open end. A shoulder is formed within the tubular body between the open ends. A seal is connected to the shoulder so as to form a liquid-tight seal with a duct received within one of the open ends. A compression device is hingedly connected to the tubular body for urging the duct into compressive contact with the seal. The compression device has a portion extending exterior of the tubular body.

U.S. patent application Ser. No. 09/752,126, filed on Dec. 29, 2000 filed on by the present inventor, does describe a tendon-receiving duct having longitudinal channels. In this patent application, two forms of the duct are described. One form has a generally circular section and the other form has a generally oval cross section. The longitudinal channels are evenly spaced around the duct. These longitudinal channels extend for the length of the duct and allow each of the corrugations to connect with each other. As a result, when grout is introduced into the interior passageway of the duct, it will flow between the corrugations along the longitudinal channels so as to effectively fill the interior of the duct with grout. The longitudinal channels provide a certain amount of rigidity and straightness to the duct so as to facilitate installation of cables therein.

A difficulty associated with the product of U.S. patent application Ser. No. 09/752,126 is that the even placement of the channels around the circumference of the duct does not assure that any particular channel resides in the uppermost position. The orientation of the duct is subject to random placement upon underlying rebars or other structures. If the orientation of the channels is such that no channel appears at the direct top of the duct, then would be a possibility of air bubbles migrating to the inner wall of the duct in the area between the channels. Under conditions of great load capacities, the duct could hinge in the areas of the channels. Since the duct experiences large forces on the bottom thereof, the random orientation of the channels would not assure proper support for the bottom surfaces of the duct. As such, a need developed to slightly improve the construction of this prior duct of the present inventor.

It is an object of the present invention to provide a tendon-receiving duct which improves the rigidity of the duct in the longitudinal direction.

It is another object of the present invention to provide a tendon-receiving duct which facilitates the removal of air bubbles within the interior of the duct.

It is a further object of the present invention to provide a tendon-receiving duct apparatus which facilitates the ability to install the cable within the duct.

It is still a further object of the present invention to provide a tendon-receiving duct which is easy to manufacture, easy to use, and relatively inexpensive.

It is a further object of the present invention to provide a tendon-receiving duct which provides an automatic orientation of the duct so that a channel is formed at the top of the duct.

It is an other object of the present invention to provide a tendon-receiving duct which reduces undulations along the length of the duct.

It is a further other object of the present invention to provide a tendon-receiving duct which minimizes restrictions during the installation of cables or tendons on the interior of the duct.

It is a further object of the present invention to provide a tendon-receiving duct which provides a structure which avoids hinging in the areas of the channels.

These and other objects and advantages of the present invention will become apparent from a reading of the attached specification and appended claims.

BRIEF SUMMARY OF THE INVENTION

The present invention is a tendon receiving duct comprising a tubular body having a longitudinal axis and plurality of corrugations extending radially outwardly therefrom. Each of the corrugations is in spaced relationship to an adjacent corrugation. The tubular body has an interior passageway suitable for receiving cables therein. Each of the plurality of corrugations opens to the interior passageway. The tubular body has a first longitudinal channel extending between adjacent pairs of the plurality of corrugations on a one side of the tubular body. The tubular body has a pair of longitudinal channels extending between adjacent pairs of the plurality of corrugations on an opposite side of the tubular body.

The pair of longitudinal channels are in spaced parallel relationship to each other. Each of the pair of longitudinal channels is spaced by approximately 160° in respective opposite directions from the first longitudinal channel around the circumference of the tubular body. The pair of longitudinal channels have an exterior surface that is co-planar with each other and also co-planar with an exterior surface of the tubular body.

The first longitudinal channel is positioned at a top of the tubular body. The pair of longitudinal channels are positioned at a bottom of the tubular body. The first longitudinal channel and the pair of longitudinal channels extend for an entire length of the tubular body. Each of the channels opens at opposite ends of the tubular body. The tubular body has a wall extending between the adjacent corrugations. Each of the first longitudinal channel and the pair of longitudinal channels extends outwardly of this wall. The longitudinal channels open to the interior passageway of the tubular body. Each of the first longitudinal channel and the pair of longitudinal channels has one end opening to one of the pair of corrugations and an opposite end opening to the other of the pair of corrugations. The longitudinal channels connect the plurality of corrugations in fluid communication. The longitudinal channels extend outwardly of the tubular body by a distance equal to the distance that the plurality of corrugations extend outwardly of the tubular body.

The tubular body has a circular cross section in a plane transverse to a longitudinal axis of the tubular body. The tubular body, the plurality of corrugations, the first longitudinal channel and the pair of longitudinal channels are integrally formed together of a polymeric material.

In an alternative form of the present invention, a plurality of tendons will extend through the interior passageway of the tubular body. A grout material fills the interior passageway of the tubular body. This grout material will also fill the plurality of corrugations and the longitudinal channels. As used herein, the term "tendons" can refer to various items, such as construction cables, wire rope, rebar and related items.

DETAILED DESCRIPTION OF THE INVENTION

Figure 1:
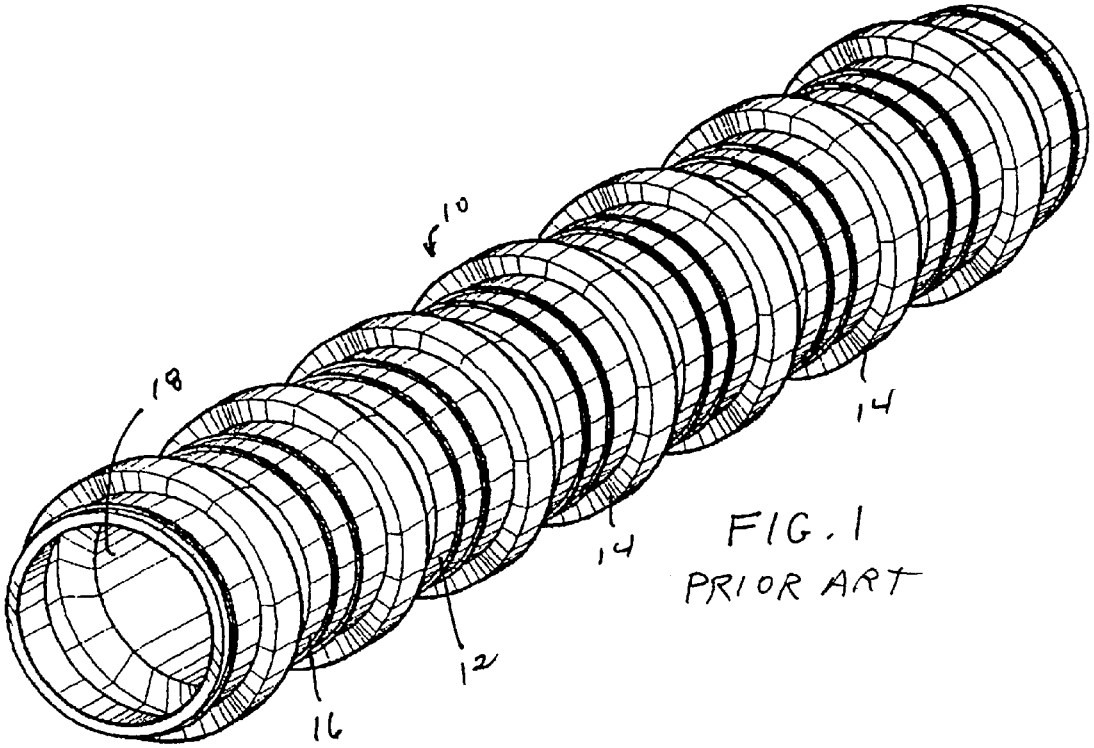
FIG. 1 PRIOR ART
FIG. 1 is an upper perspective view showing a prior art tendon-receiving duct.
Figure 2:
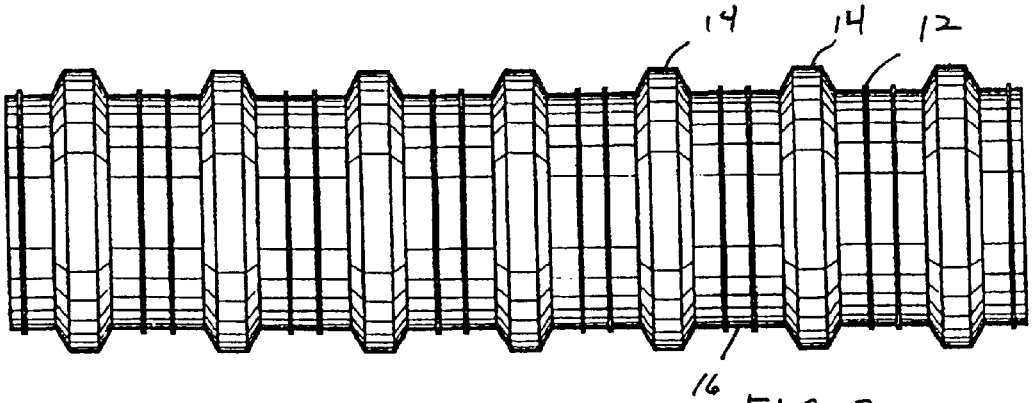
FIG. 2 PRIOR ART
FIG. 2 is a side elevational view of the prior art tendon-receiving duct shown in FIG. 1.
Figure 3:
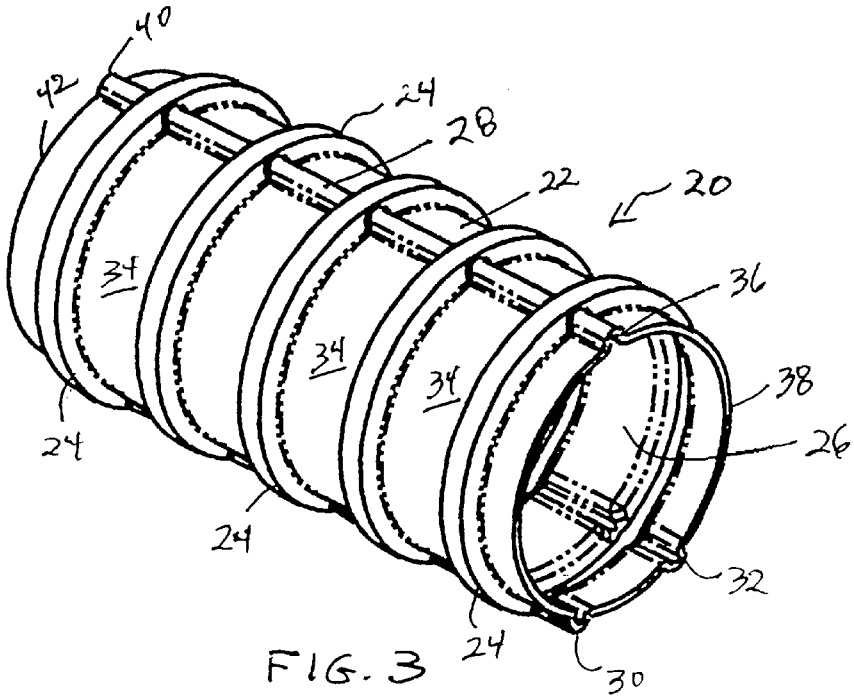
FIG. 3 is an upper perspective view of the tendon-receiving duct in accordance with the teachings of the present invention.

Referring to FIG. 3, there is shown the tendon-receiving duct 20 in accordance with the teachings of the preferred embodiment of the present invention. The tendon-receiving duct 20 includes a tubular body 22 having a plurality of corrugations 24 extending radially outwardly of the tubular body 22. Each of the corrugations 24 is in spaced relationship to an adjacent corrugations 24. The tubular body has an interior passageway 26 suitable for receiving tendons (or post-tension cables) therein. Each of the plurality of corrugations 24 open within the tubular body 22 to the interior passageway 26. A first longitudinal channel 28 is formed on the top side of the tubular body 22 and extends so as to communicate between the corrugations 24. A pair of longitudinal channels 30 and 32 are formed on the bottom side of the tubular body 22. This pair of longitudinal channels 30 and 32 also communicate between the corrugations 24.

The tubular body 22 has a wall section 34 formed between adjacent pairs of corrugations 24 on the tubular body 22. The wall portion 34 defines the inner wall of the interior passageway 26. The longitudinal channel 28 will extend between the corrugations 24 in parallel relationship to the longitudinal axis of the tubular body 22. Similarly, the pair of longitudinal channels 30 and 32 will extend between the corrugations 24. Each of the longitudinal channels 28, 30 and 32 has an interior which opens to the interior passageway 26.

As can be seen in FIG. 3, the first longitudinal channel 28 and the pair of longitudinal channels 30 and 32 extend for the entire length of the tubular body 20. The first longitudinal channel 28 will have one end 36 opening at the end 38 of the tubular body 22. Similarly, the first channel 28 will have an opposite end 40 opening at the opposite end 42 of the tubular body 22. Each of the pair of longitudinal channels 30 and 32 will have a first end opening at the end 38 of the tubular body 22 and an opposite end opening at the opposite end 42 of the tubular body 22. The longitudinal channels 28, 30 and 32 extend outwardly of the wall portion 34. The longitudinal channels 28, 30 and 32 will serve to connect the plurality of corrugations 24 in fluid communication with each other. The longitudinal channels 28, 30 and 32 extend outwardly of the wall portion 34 of the tubular body 22 by a distance equal to the distance that the plurality of corrugations 24 extend outwardly of the tubular body 22. It can be seen that the tubular body 22 has a circular cross section in a plane transverse to the longitudinal axis of the tubular body 22. Each of the tubular body 22, the plurality of corrugations 24, the first longitudinal channel 28, and the pair of longitudinal channels 30 and 32 are integrally formed together of a polymeric material in an injection molding process.

In normal use, when grout is introduced into the interior passageway 26, it will begin to fill the void within the interior passageway 26. The grout will initially fill the interior of the adjacent corrugation 24 and push air bubbles upwardly and outwardly therefrom. These air bubbles can migrate along the first longitudinal channel 28 toward the next corrugation 24. The grout can then flow between the corrugations 24 along the pair of longitudinal channels 30 and 32 at the bottom of the duct 20. Eventually, the grout will fill the channels 28, 30 and 32 and slowly move along the length of the tubular body 22. As a result of the uppermost positioning of the first longitudinal channel 28, it can be assured that the air bubbles will migrate into the channel 28 so as to be properly pushed by the grout toward the end of the duct 20. A suitable valve, or other device, can be used so as to release the migrated air from the interior passageway 26 at the end of the duct 20.

Importantly, the longitudinal channels 28, 30 and 32 provide rigidity and stiffness along the longitudinal axis of the tubular body 22. As a result, the tubular body 22 is less likely to curl up, whip or wobble during the installation of the tendons or cable by a cablepusher. The added stiffness provided by the longitudinal channels 28, 30 and 32 allows cables to be installed in a quicker and more convenient manner. There is less likelihood of duct breakage when the tendons are installed. The minimization of whip, wobble, and undulations caused by the construction of the channels 28, 30 and 32 will further reduce the likelihood of duct breakage.

It is important to note that the duct 20 will typically rest on underlying surface, such as rebars or post-tension cables. Such structures provide a relatively small point of contact with the relatively thin walls of the duct 20. As a result, in prior art ducts, there was a possibility of indentations created by the strong forces imparted by the weight supported by the duct 20 and the contact force with the underlying structures. The present invention addresses this problem by providing the pair of longitudinal channels 30 and 32 at the bottom of the duct 20. As a result, three points of contact will be provided with the underlying surface. These points of contact include the surfaces of the channels 30 and 32 and the lowermost portion of the wall 34. As a result, undulations and indentations are prevented. The arrangement of the top longitudinal channel 28 and the bottom longitudinal channels 30 and 32 are configured so as to eliminate "hinging" in the areas of the channels. It can be seen that the top channel 28 is positioned in an offset relationship from the bottom channels 30 and 32. The lack of direct alignment of the channels will prevent hinging from occurring.

Importantly, the present invention provides an automatic centering effect. Unlike prior art ducts, it is relatively easy for the worker at the construction site to determine the top and the bottom of the duct 20. The single channel 28 will appear at the top of the duct 20 and the pair of channels 30 and 32 will appear at the bottom of the duct 20. As a result, the duct 20 will always be installed in its desired orientation so that the support channels 30 and 32 will contact the underlying surface.

Figure 4:
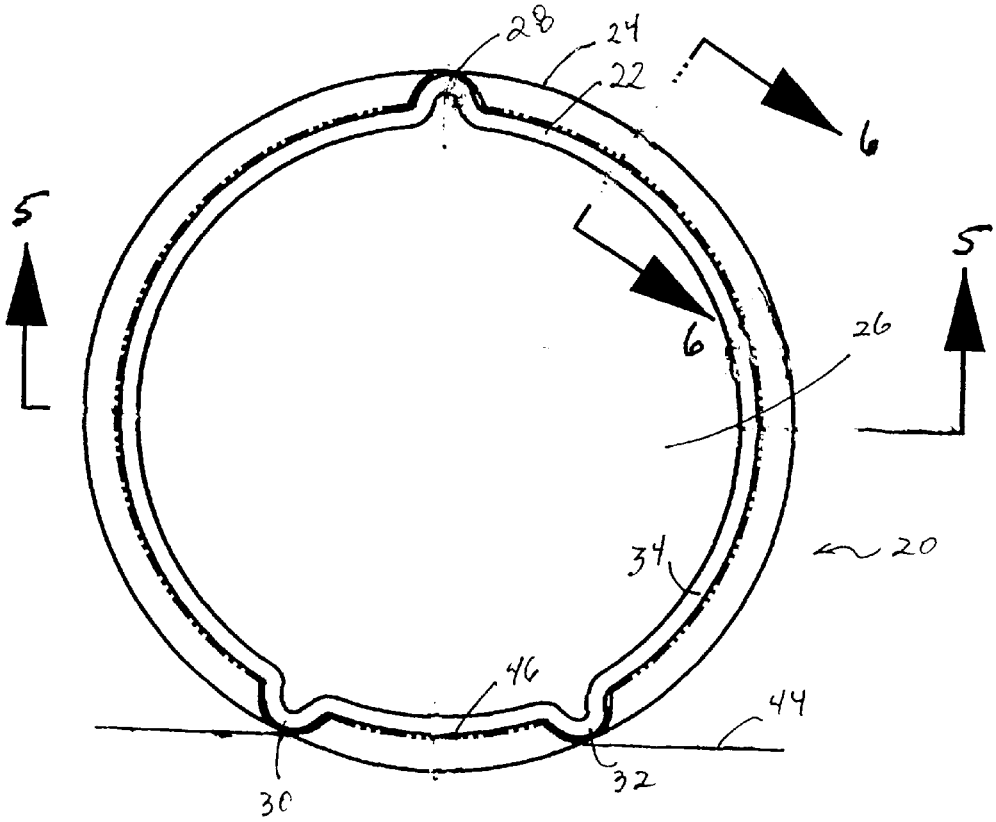
FIG. 4 is an end view of the tendon-receiving duct in accordance with the teachings of the present invention.

Referring to FIG. 4, the end view of the duct 20 is particularly shown. The first longitudinal channel 28 is illustrated as formed in the direct top of the tubular body 22. The first longitudinal channel 28 has a height which is generally equal to the height of the outer surface of the corrugation 24. The first longitudinal channel 28 opens to the interior passageway 26 of the tubular body 22. The pair of longitudinal channels 30 and 32 are formed adjacent to the bottom of the tubular body 22. In particular, the pair of longitudinal channels 30 and 32 are spaced by approximately 160–170°, in opposite directions, respectively, from the first longitudinal channel 28 around the circumference of the tubular body 22. Each of the pair of longitudinal channels 30 and 32 extends outwardly from the wall 34 by a distance equal to the distance that the corrugation 24 extends outwardly from wall 34. Each of the longitudinal channels 30 and 32 opens to the interior passageway 26 of the tubular body 22. An underlying surface 44 is particularly shown in FIG. 4. It can be seen that the pair of longitudinal channels 30 and 32 will rest in co-planar relationship with the surface 44. It can be also seen that a point of contact 46 on the outer surface of wall 34 would also contact the underlying surface 44. As a result, there are three points of contact between the bottom surface of the duct 20 and the underlying surface 44. This will provide a suitable rigidifying effect and will avoid indentations through the wall 34 created by forces between the underlying surface 44 and the weight supported by the duct 20.

Figure 5:
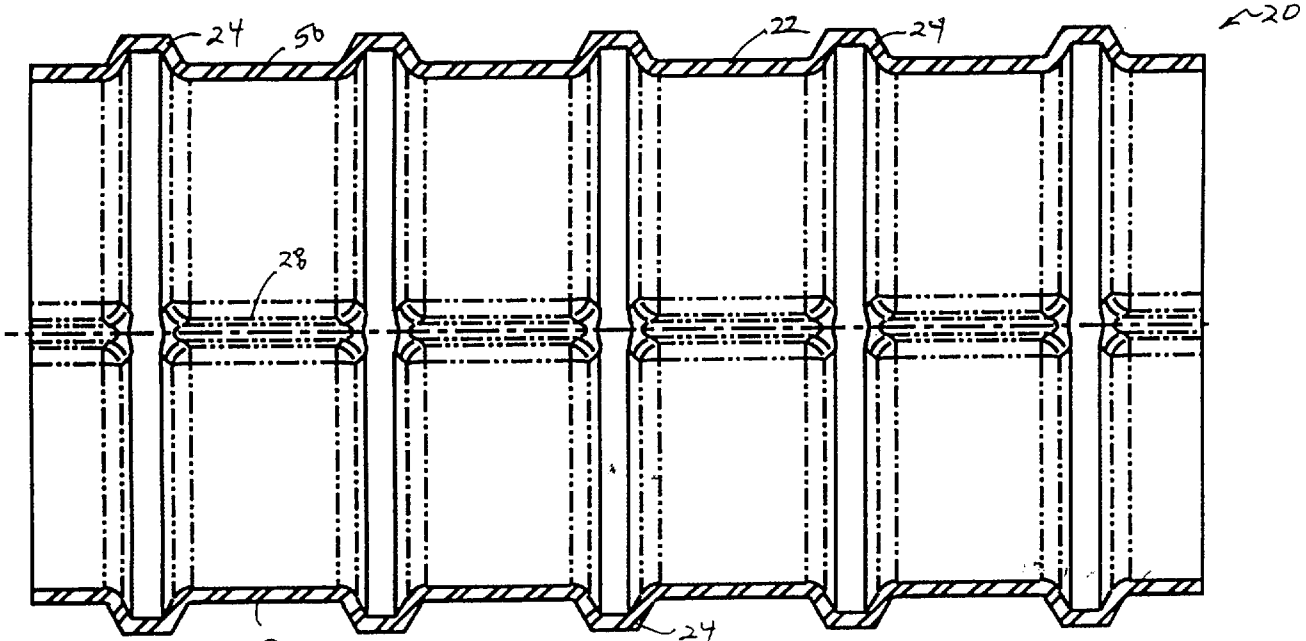
FIG. 5 is a cross-sectional view as taken across lines 5—5 of FIG. 4.

FIG. 5 is a cross-sectional view of the duct 20. In particular, it can be seen that the first longitudinal channel 28 extends generally centrally between the side 50 and 52 of the tubular body 22. Corrugations 24 extend in generally spaced parallel relationship to each other in transverse orientation to the longitudinal axis of the tubular body 22. The longitudinal channel 28 is illustrated as having its ends, along its length, opening to the corrugations 24. As a result, grout and air bubbles will naturally migrate along the length of the tubular body 22.

Figure 6:
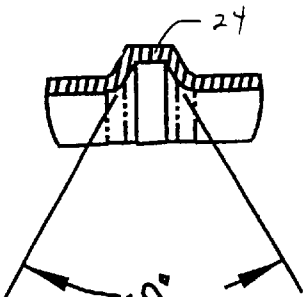
FIG. 6 is a cross-sectional view as taken across lines 6—6 if FIG. 4.

FIG. 6 shows a detailed view of a particular corrugation 24. Corrugations 24 are illustrated as having walls that extend at an approximately 60° angle with respect to each other. This angled orientation of the walls facilitates manufacturing and also facilitates air bubble migration to the outermost regions of each corrugation 24. The 60° angle will tend to "funnel" air bubbles to the outermost surfaces and also funnel such air bubbles upwardly toward the first longitudinal channel 28.

Figure 7:
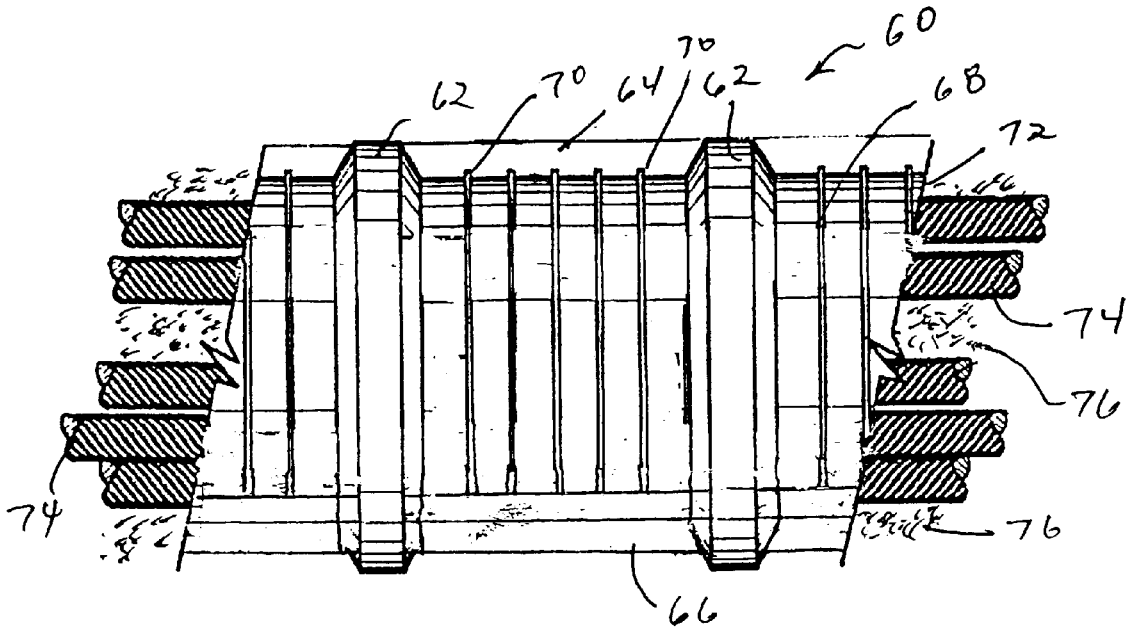
FIG. 7 is a side elevational view of the tendon-receiving duct of the present invention as partially sectioned so as to show the tendons therein.

FIG. 7 shown an alternative embodiment of the present invention in which the duct 60 has corrugations 62 with a first longitudinal channel 64 and a pair of longitudinal channels 66. The first longitudinal channel 64 is at top of the tubular body 68. The pair of channels 66 are located at the bottom of the tubular body 68. In FIG. 7, a further stiffening effect is created by the formation of small ribs 70 extending transversely to the longitudinal axis of the tubular body 68. Each of the ribs 70 is in spaced parallel relationship to each other and will extend around the diameter of the tubular body 68. In FIG. 7, it can be seen that the tubular body 68 has an interior passageway 72 into which a plurality of tendons or cables 74 extend. A suitable grout material 76 fills the interior passageway 72 of the tubular body 68 and will surround the tendons 74 within the tubular body 68. As a result, a relatively air and water tight relationship is established between the duct 60 and those tendons 74 extending within the duct 60.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A tendon receiving duct comprising:

a tubular body having a longitudinal axis, said tubular body having a plurality of corrugations extending radially outwardly therefrom, each of said plurality of corrugations being in spaced relation to an adjacent corrugation, said tubular body having an interior passageway suitable for receiving cables therein, each of said plurality of corrugations opening to said interior passageway, said tubular body having a first longitudinal channel extending between adjacent pairs of said plurality of corrugations on one side of said tubular body, said tubular body having a pair of longitudinal channels extending between adjacent pairs of said plurality of corrugations on an opposite side of said tubular body, said pair of longitudinal channels having an exterior surface coplanar with each other, each of said pair of longitudinal channels being spaced by approximately 160°–170° respectively in opposite directions from said first longitudinal channel.

2. The duct of claim 1, said pair of longitudinal channels being in spaced parallel relationship to each other.

3. The duct of claim 1, said first longitudinal channel positioned at a top of said tubular body, said pair of longitudinal channels positioned at a bottom of said tubular body.

4. The duct of claim 1, said first longitudinal channel and said pair of longitudinal channels extending for an entire length of said tubular body.

5. The duct of claim 4, each of said first longitudinal channel and said pair of longitudinal channels opening at opposite ends of said tubular body.

6. The duct of claim 1, said tubular body having a wall extending between adjacent corrugations, each of said first longitudinal channel and said pair of longitudinal channels extending outwardly of said wall, said first longitudinal channel and said pair of longitudinal channels opening to said interior passageway of said tubular body.

7. The duct of claim 1, each of said first longitudinal channel and said pair of longitudinal channels having one end opening to one of said pair of corrugations and an opposite end opening to the other of said pair of corrugations.

8. The duct of claim 1, said first longitudinal channel and said pair of longitudinal channels connecting said plurality of corrugations in fluid communication.

9. A tendon receiving duct comprising:

a tubular body having a longitudinal axis, said tubular body having a plurality of corrugations extending radially outwardly therefrom, each of said plurality of corrugations being in spaced relation to an adjacent corrugation, said tubular body having an interior passageway suitable for receiving cables therein, each of said plurality of corrugations opening to said interior passageway, said tubular body having a first longitudinal channel extending between adjacent pairs of said plurality of corrugations on one side of said tubular body, said tubular body having a pair of longitudinal channels extending between adjacent pairs of said plurality of corrugations on an opposite side of said tubular body, said first longitudinal channel and said pair of longitudinal channels extending outwardly of said tubular body by a distance equal to a distance that said plurality of corrugations extend outwardly of said tubular body.

10. The duct of claim 9, said tubular body having a circular cross-section in a plane transverse to said longitudinal axis of said tubular body.

11. The duct of claim 9, said tubular body and said plurality of corrugations and said first longitudinal channel and said pair of longitudinal channels being integrally formed together of a polymeric material.

12. An apparatus comprising:

a tubular body having a longitudinal axis and an interior passageway, said tubular body having a first longitudinal channel formed on a top of said tubular body, said tubular body having a pair of longitudinal channels formed on a bottom of said tubular body, said plurality of longitudinal channels being in spaced relationship to each other;

a plurality of tendons extending through said interior passageway of said tubular body; and a grout material filling said interior passageway of said tubular body.

13. The apparatus of claim 12, said grout material filling said first longitudinal channel and said pair of longitudinal channels.

* * * * *